US012710257B2

(12) United States Patent
Pedicini et al.

(10) Patent No.: US 12,710,257 B2
(45) Date of Patent: Aug. 18, 2026

(54) ENHANCED PAYLOAD DELIVERY

(71) Applicant: Helix Defense, LLC, Brentwood, TN (US)

(72) Inventors: Christopher Pedicini, Brentwood, TN (US); Joshua Pedicini, Nashville, TN (US)

(73) Assignee: HELIX DEFENSE, LLC, Brentwood, TN (US)

( * ) Notice: Subject to any disclaimer, the term of this patent is extended or adjusted under 35 U.S.C. 154(b) by 0 days.

(21) Appl. No.: 19/289,620

(22) Filed: Aug. 4, 2025

(65) Prior Publication Data

US 2025/0362120 A1 Nov. 27, 2025

Related U.S. Application Data

(63) Continuation-in-part of application No. 19/045,923, filed on Feb. 5, 2025.

(60) Provisional application No. 63/806,138, filed on May 15, 2025, provisional application No. 63/742,481, filed on Jan. 7, 2025, provisional application No. (Continued)

(51) Int. Cl.

| | |
|---|---|
| ***F42B 12/40*** | (2006.01) |
| ***F42B 10/14*** | (2006.01) |
| ***F42B 12/46*** | (2006.01) |
| ***F42B 12/56*** | (2006.01) |

(52) U.S. Cl.

CPC ..... *F42B 12/40* (2013.01); *F42B 10/14* (2013.01); *F42B 12/46* (2013.01); *F42B 12/56* (2013.01)

(58) Field of Classification Search

CPC ..... F42B 12/40; F42B 10/14; F42B 12/46; F42B 12/56; F42B 6/02; F42B 12/36; F42B 6/006

See application file for complete search history.

(56) References Cited

U.S. PATENT DOCUMENTS

| | | |
|---|---|---|
| 6,202,532 B1 | 3/2001 | Kadushin |
| 7,533,612 B1 | 5/2009 | Papayianis et al. |

(Continued)

FOREIGN PATENT DOCUMENTS

| | | |
|---|---|---|
| EP | 0779495 A1 | 6/1997 |

OTHER PUBLICATIONS

International Search Report and Written Opinion of the International Searching Authority issued Oct. 7, 2025 in corresponding International Patent Application No. PCT/US2025/032451, 21 pages.

(Continued)

*Primary Examiner* — Rodney A Bonnette
(74) *Attorney, Agent, or Firm* — XSENSUS LLP

(57) ABSTRACT

A device may include a set of payloads and a mechanism. The set of payloads may be configured to interact with at least one of an airborne device or a component of the airborne device via at least one of physical entanglement, sensor obscuration, or surface adhesion. The mechanism may be operable between an inactive state and an active state. The mechanism may be configured to transition to the active state in response to inductive energy generated by relative motion through a magnetic field during launch, and deploy the set of payloads based on at least one of one or more elapsed times during travel of the device along the trajectory, one or more positions of the device along the trajectory, or one or more distances traveled by the device along the trajectory.

12 Claims, 9 Drawing Sheets

Related U.S. Application Data

63/677,383, filed on Jul. 30, 2024, provisional application No. 63/549,928, filed on Feb. 5, 2024.

(56) References Cited

U.S. PATENT DOCUMENTS

| | | | | |
|---|---|---|---|---|
| 9,140,526 | B1 | 9/2015 | Calvert | |
| 10,197,365 | B1 * | 2/2019 | Blyskal | F41H 13/0006 |
| 2001/0039897 | A1 | 11/2001 | Renaud-Bezot et al. | |
| 2017/0261292 | A1 * | 9/2017 | Armstrong | F41H 11/02 |
| 2020/0108925 | A1 * | 4/2020 | Smith | B64U 70/30 |
| 2020/0318935 | A1 | 10/2020 | Pedicini et al. | |
| 2021/0095940 | A1 | 4/2021 | Pedicini et al. | |
| 2023/0194225 | A1 | 6/2023 | Pedicini et al. | |
| 2024/0302143 | A1 | 9/2024 | Parker et al. | |
| 2024/0426569 | A1 * | 12/2024 | Martire | F41B 6/00 |

OTHER PUBLICATIONS

International Search Report and Written Opinion issued Apr. 23, 2026 in corresponding International Patent Application No. PCT/US2026/012805, 21 pages.

* cited by examiner

ENHANCED PAYLOAD DELIVERY

CROSS-REFERENCE TO RELATED APPLICATIONS

This application claims the benefit of U.S. Provisional Application No. 63/806,138. filed May 15, 2025, and is a continuation-in-part of U.S. Nonprovisional application Ser. No. 19/045,923, filed Feb. 5, 2025, which claimed the benefit of U.S. Provisional Application No. 63/742,481, filed Jan. 7, 2025, U.S. Provisional Application No. 63/677,383, filed Jul. 30, 2024, and U.S. Provisional Application No. 63/549,928, filed Feb. 5, 2024, the contents of all of which are incorporated herein by reference in their entireties.

BACKGROUND

Airborne devices, such as unmanned aerial vehicles (UAVs), include systems that enable the airborne devices to fly (e.g., along a flight path through air). For example, the systems may include flight control, propulsion, vision, and/or navigation systems, which allow the airborne devices to fly autonomously and/or through remote operation.

SUMMARY

In some aspects, the techniques described herein relate to a device configured to travel along a trajectory, the device including: a set of payloads configured to interact with at least one of an airborne device or a component of the airborne device via at least one of physical entanglement, sensor obscuration, or surface adhesion; and a mechanism operable between an inactive state and an active state, wherein the mechanism is configured to: transition to the active state in response to inductive energy generated by relative motion through a magnetic field during launch, and deploy the set of payloads based on at least one of: one or more elapsed times during travel of the device along the trajectory, one or more positions of the device along the trajectory, or one or more distances traveled by the device along the trajectory.

In some aspects, the techniques described herein relate to a device configured to travel along a trajectory, including: a set of payloads configured to interact with at least one of an airborne device or a component of the airborne device via at least one of physical entanglement, sensor obscuration, or surface adhesion; a rotation control component operable between a non-deployed state and a deployed state and configured to at least one of inhibit or prevent rotation of the device during travel of the device along the trajectory; and a mechanism configured to deploy the set of payloads based on at least one of: one or more elapsed times during travel of the device along the trajectory, one or more positions of the device along the trajectory, or one or more distances traveled by the device along the trajectory, wherein the rotation control component is configured to transition from the non-deployed state to the deployed state during travel of the device along the trajectory.

In some aspects, the techniques described herein relate to a system, including: a first device including: a set of payloads configured to interact with at least one of an airborne device or a component of the airborne device via at least one of physical entanglement, sensor obscuration, or surface adhesion; a mechanism operable to transition from an inactive state to an active state; and a second device configured to create a magnetic field and impart motion to the first device, the first device being configured to travel along a trajectory based on the motion, wherein the mechanism is configured to: transition to the active state based on inductive energy generated by moving through the magnetic field, and deploy the set of payloads based on at least one of: one or more elapsed times during travel of the first device along the trajectory, one or more positions of the first device along the trajectory, or one or more distances traveled by the first device along the trajectory.

DETAILED DESCRIPTION OF EXAMPLE EMBODIMENTS

The following detailed description of example implementations refers to the accompanying drawings. The same reference numbers in different drawings may identify the same or similar elements.

Typical counter-unmanned aircraft systems (C-UAS) utilize electronic warfare, kinetic destruction, and capture-based systems, each of which being associated with drawbacks and problems. For example, electronic warfare systems can interfere with friendly assets and require sophisticated coordination to avoid collateral damage, kinetic destruction methods demand precise targeting (e.g., which results in potential collateral damage or inefficiency in diverse environments), and capture-based systems are limited by range and scalability (e.g., which makes capture-based systems impractical for widespread use).

Figure 1:
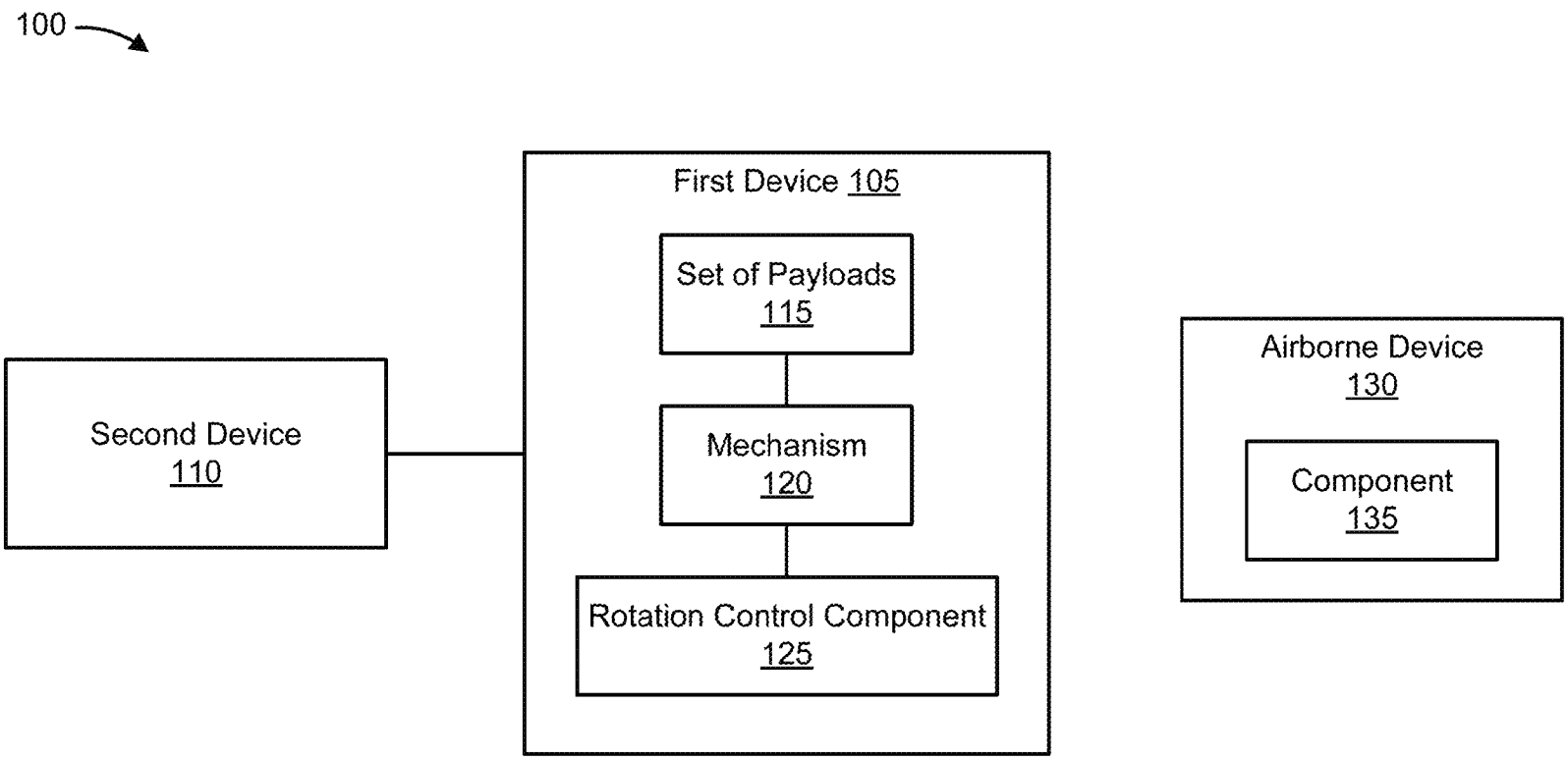
FIG. 1 is a diagram of an example associated with enhanced payload delivery.

FIG. 1 is a diagram of an example 100 associated with enhanced payload delivery. As shown in FIG. 1, the example 100 may include a first device 105, a second device 110, a set of payloads 115, a mechanism 120, a rotation control component 125, an airborne device 130 (e.g., shown as including a component 135).

In some implementations, the first device 105 may be configured to travel along a trajectory. For example, the second device 110 may be configured to launch the first device 105 along the trajectory. Accordingly, for example, the second device 110 may wherein the second device 110 may include a manually-operated launcher, a vehicle-mounted launcher, an integrated ground-based launcher, an aerial launcher, an airborne launcher, a remotely-operated launcher, and/or an automated launcher, among other examples.

In some implementations, physical characteristics of the first device 105 and the second device 110 may be configured to conform to a form factor, such as a standardized form factor for interoperability. For example, the physical characteristics of the first device 105 may conform to a form factor of a 40-millimeter projectile, and the physical characteristics of the second device 110 may be configured to facilitate propulsion of a 40-millimeter projectile; however, the physical characteristics of the first device 105 and/or the second device 110 may be any suitable physical characteristics (e.g., based on and/or conforming to any suitable caliber of any suitable projectile, such as calibers in a range from approximately 12 millimeters to approximately 150 millimeters and/or projectile diameters in a range from approximately 13 millimeters up to 70 millimeters, among other examples).

In some implementations, the first device 105 may include a housing configured to separate (e.g., during travel of the first device 105 along the trajectory), into one or more fragments that disperse in air and being configured to physically engage with the airborne device 130 and/or the component 135 of the airborne device 130.

In some implementations, the set of payloads 115 may be configured to interact with the airborne device 130 and/or the component 135 of the airborne device 130. For example, the set of payloads 115 may be configured to interact with the airborne device 130 and/or the component 135 of the airborne device 130 via physical entanglement, sensor obscuration, and/or surface adhesion.

In some implementations, the physical entanglement, the sensor obscuration, and/or the surface adhesion may include physically entangling using an entanglement element (e.g., a streamer filament and/or a weighted strand, among other examples), providing contact-based disruption using at least one fragment, impairing at least one sensor using airborne obscurant particles, providing thermal interference, providing spectral sensing disruption, and/or providing adhesive surface alteration, among other examples.

In some implementations, at least one payload may include particles having shapes and sizes configured to promote suspension in air and/or impair the component 135 (e.g., a sensor, among other examples) associated with the airborne device 130. For example, the shapes may include a flake shape and/or a spherical shape, among other examples. As another example, the sizes may be less than or equal to 100 microns, among other examples.

In some implementations, the mechanism 120 may be configured to transition from the inactive state to the active state in response to inductive energy generated by relative motion through a magnetic field during launch. For example, the second device 110 may be configured to create a magnetic field and impart motion to the first device 105 (e.g., the first device 105 may be configured to travel along a portion of the second device 110 in response to the motion imparted by the second device 110) and the mechanism 120 may be configured to transition from the inactive state to the active state based on inductive energy generated by moving through the magnetic field.

In some implementations, the mechanism 120 may be configured to deploy the set of payloads 115 based on one or more elapsed times during travel of the first device 105 along the trajectory, one or more positions of the first device 105 along the trajectory, and/or one or more distances traveled by the first device 105 along the trajectory, among other examples.

In some implementations, the mechanism 120 may be configured to deploy payloads sequentially to form multiple interaction zones. For example, the multiple interaction zones may be spatially distinct from one another and/or may be formed at different times.

In some implementations, the at least one payload may include particles having shapes and/or sizes configured to promote suspension in air, impair the airborne device 130, and/or impair the component 135 (e.g., a sensor, among other examples) of the airborne device 130. For example, the shapes may include a flake shape and/or a spherical shape, among other examples. As another example, the sizes may be less than or equal to 100 microns, among other examples.

In some implementations, at least one payload may include particles having magnetically-responsive materials and/or iron-containing particles configured to impair a magnetic system and/or an electronic system of the airborne device 130.

In some implementations, at least one payload may include a set of visual cues configured to indicate a release path and/or an interaction region. For example, the set of visual cures may include a tracer compound, a color-coded dye, and/or a phosphorescent marker, among other examples, configured to indicate the release path and/or the interaction region.

In some implementations, at least one payload may include a set of entanglement elements (e.g., a set of streamers and/or a set of filaments, among other examples) configured to unwind (e.g., from a wound state) and/or unravel (e.g., from a raveled state) during travel of the first device 105 along the trajectory to create an entanglement volume. For example, the entanglement element may be composed of an ultra-high-molecular-weight polyethylene (UHMWPE), a nylon, a polyester, a cellulose, and/or a cellulose-based material configured to unwind and/or unravel during travel of the first device 105 along the trajectory to create the entanglement volume.

In some implementations the set of entanglement elements may be coupled to the first device 105 and configured to be deployed (e.g., the set of entanglements may be configured to be unwound and/or unraveled), during travel of the first device 105 along the trajectory, in a direction different from a direction of travel of the first device 105 (e.g., in an opposite direction to the direction of travel of the first device 105) to form an elongated aerial denial volume. In some implementations, the first device 105 may be configured to be stabilized based on the set of entanglement elements, such as after the set of entanglement elements have been deployed.

In some implementations, the set of entanglement elements may include at least a first entanglement element coupled to a second entanglement element (e.g., a first material coupled to a second material). In some implementations, the first entanglement element may be configured to initiate deployment of the second entanglement element during travel of the first device 105 along the trajectory.

In some implementations, the set of entanglement elements may be configured to be wound in multiple spatially separated layers, such as within the first device 105. In some implementations, the mechanism 120 may be configured to deploy the set of entanglement elements to create an extended entanglement zone along the trajectory.

In some implementations, at least one payload may include a set of fluids and/or a set of gels configured to provide adhesive surface alteration (e.g., in association with the airborne device 130 and/or the component 135 of the airborne device 130). For example, the set of fluids and/or the set of gels may include a glycerin-based mist, a biodegradable tackifier, a cyanoacrylate-based, a urethane material, a latex material, and/or a rubber-based agent, among other examples, configured to provide adhesive surface alteration configured to provide adhesive surface alteration (e.g., in association with the airborne device 130 and/or the component 135 of the airborne device 130).

In some implementations, to deploy one or more payloads, the mechanism 120 may be configured to utilize a spring-loaded deployment system, a pyrotechnic actuator, an inertially-triggered release system activated by an acceleration threshold and/or a velocity threshold, and/or a rupture-based pressure vessel configured to fail along a pre-weakened seam associated with the first device 105, among other examples.

In some implementations, the mechanism 120 may be configured to deploy payloads in at least two different directions. For example, the mechanism 120 may be configured to deploy payloads in a first direction (e.g., a rearward direction or a direction opposite a direction of travel of the first device 105 along the trajectory) and second direction (e.g., at least one of a vertical direction or a lateral direction relative to a point along the trajectory), among other examples.

In some implementations, the mechanism 120 may be configured to initiate a separation event associated with a portion of the first device 105 separating from the first device 105 and at least one payload may be configured to be deployed based on the separation event.

In some implementations, the mechanism 120 may be configured to operate in a selectable termination mode. For example, the selectable termination mode may include a radial deployment mode configured to eject payloads at least one of outward at, or outward near, an apex of the trajectory to form a volumetric denial zone. As another example, the selectable termination mode may include a trailing deployment mode configured to release payloads progressively, such as during a descent of the first device 105 along the trajectory to form a parabolic curtain, among other examples.

In some implementations, the rotation control component 125 may be operable between a non-deployed state and a deployed state. In some implementations, the rotation control component 125 may be configured to at least one of inhibit or prevent rotation of the first device 105 during travel of the first device 105 along the trajectory. In some implementations, the rotation control component 125 may be configured to transition from the non-deployed state to the deployed state during travel of the first device 105 along the trajectory.

In some implementations, the rotation control component 125 may include a set of fins (e.g., aerodynamic fins) configured to deploy after launch of the first device 105 to stabilize flight of the first device 105 along the trajectory without inducing rotation of the first device 105.

As indicated above, FIG. 1 is provided as an example. Other examples may differ from what is described with regard to FIG. 1.

Figure 1A:
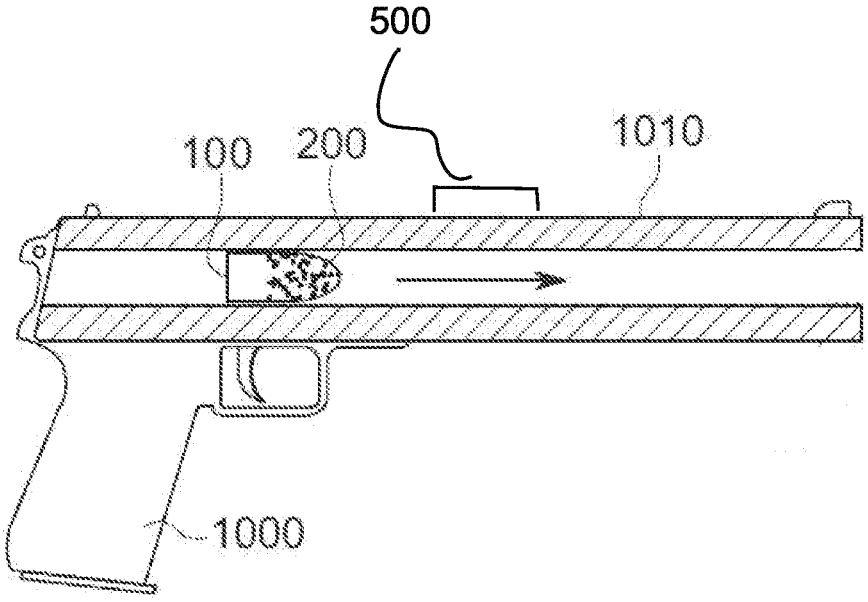
FIG. 1A shows a launcher and projectile according to an exemplary embodiment of the present disclosure.

In view of the foregoing disadvantages inherent in the prior art. the general purpose of the present disclosure is to provide a projectile construction 100 (also referred to herein as "projectile" in context), projectile launcher 1000, each as shown in FIG. 1A, (and optionally, a launcher accessory 1100 as elsewhere described herein) that include all the advantages of the prior art and overcomes the drawbacks inherent therein. As used herein, "payload" may refer to a substance, object, compound, or material that is capable of delivering a degrading or incapacitating force to and/or effect on a target. Such a payload 200 can be in powder, liquid or aerosol, or foam form and/or in the form of shrapnel (or a combination thereof) without departing from the spirit of the disclosure. The payload 200 may comprise a destabilizing material, a visible substance (such as a dye or a powder, for example) or an ink or tacky compound or a combination thereof.

Figure 1B:
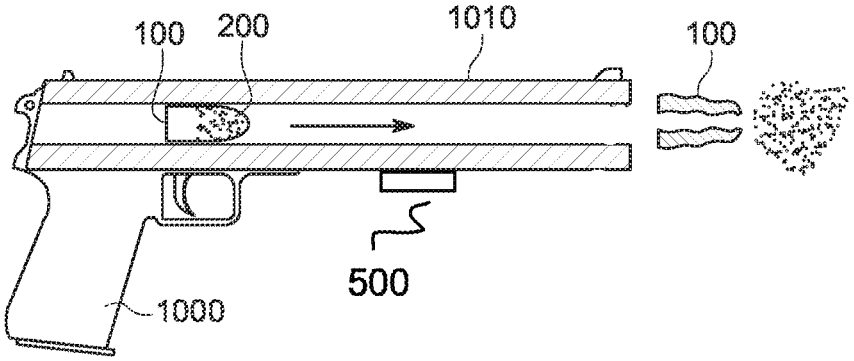
FIG. 1B shows a projectile separating after launch from a launcher to release a payload, according to an exemplary embodiment of the present disclosure.

In an embodiment, and as shown in FIG. 1B, the projectile 100 separates into two or more components upon or after exit from the barrel 1010 of the launcher 100 to distribute the payload 200. In an embodiment and as will be discussed in further detail herein, the separation can be initiated by electrical, mechanical or chemical means or by a combination thereof.

In an embodiment, the separation of the projectile 100 is in sufficient proximity to a target (such as a drone) to disperse the payload physically upon the target or in close proximity to the target.

In an embodiment, payload 200 may comprise a ferrofluid, a statically-charged powder, a magnetic or ferromagnetic powder or an opaque substance (such as a foam, ink cloud, glue mist or a powder). The payload 200 may also comprise a sticky substance or a web or other configuration that may interfere with or affect the control surfaces and or propulsion of a target. Such tacky or adhesive substance can promote effectiveness of the payload by physical attachment to the target. In an embodiment, the web-configured payload, or payload configured as streamers (or other entanglement materials) or an abrasive powder may physically impede operation of a drone's propulsion system, causing the drone to divert from its intended path or crash to the ground.

In an embodiment, where the payload 200 comprises a ferrofluid and/or a magnetic or ferromagnetic powder, such payload may be dispersed in connection with the separation or disintegration, etc. of a projectile 100 to adhere to a metal object or component or components of a target (such as the motor or propeller of a drone) and cause the component to cease operating. thus disabling the target.

Figure 2:
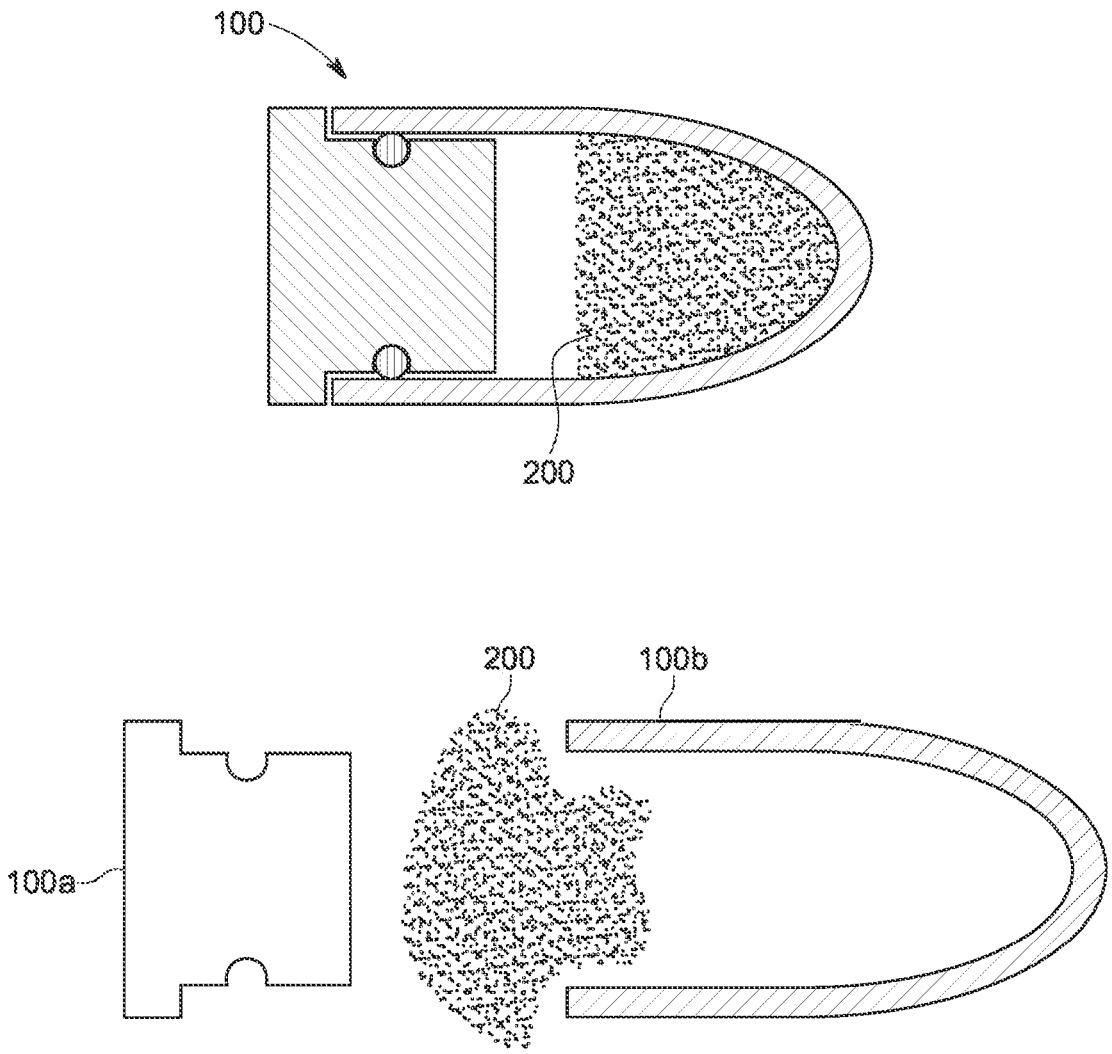
FIG. 2 shows a projectile before and after separating to release a payload, according to an exemplary embodiment of the present disclosure.

In yet another embodiment and as shown in FIG. 2, where the payload 200 of a projectile 100 comprises an opaque substance (such as a foam, ink, paint, powder or aerosol), said opaque substance may be dispersed in proximity to the target and interfere with the drone's navigational sensors or vision system or camera to impede operation of the drone. Such opaque substance material also may be enhanced by including a tackifier or sticky element causing it to adhere to the drone or UAS and affect both vision (including infrared) as well as control surfaces such as propellers, rudders etc. It is preferred that the particle size of the opaque substance is less than 150 microns. Suitable powders include titanium dioxide, carbon, activated carbon, charcoal. activated charcoal, talc, silicon aerogel, carbon aerogel and the like. Additionally, tackifiers may comprise cyanoacrylate, polyurethane, epoxies, xanthum gum, corn starch, glycerin, cornstarch, gelatin and the like. FIG. 2 also shows projectile separating into projectile portions 100*a* and 100*b* to allow payload 200 to be dispersed from the projectile.

In another embodiment, the payload of an exemplary projectile comprises an electrostatic charge. In such an embodiment, the disclosure may comprise a probe that is electrically charged (such as electrostatically charged for example) and that may be directed at and attached to a target, thus charging the target to a specific polarity (i.e. a positive or negative charge). In an embodiment, the payload is electrostatically charged to the opposite polarity of that of the target. In an embodiment, the probe attaches to the target prior to separation of the projectile. When payload is released in proximity to the probe, electrostatic attraction between the oppositely charged probe and payload may cause the payload to accumulate around the target and/or probe. In an embodiment, the launcher may launch the probe as well as the projectile.

In a still further embodiment, the projectile may be charged electrostatically at launch to a polarity that is typically opposite what a flying target object would acquire (typically drones and the like acquire a negative polarity flying through the air). Charging an exemplary projectile of the present disclosure with a positive charge would allow it to release a charged cloud which would be preferentially attracted to the drone or UAS.

Figure 3:
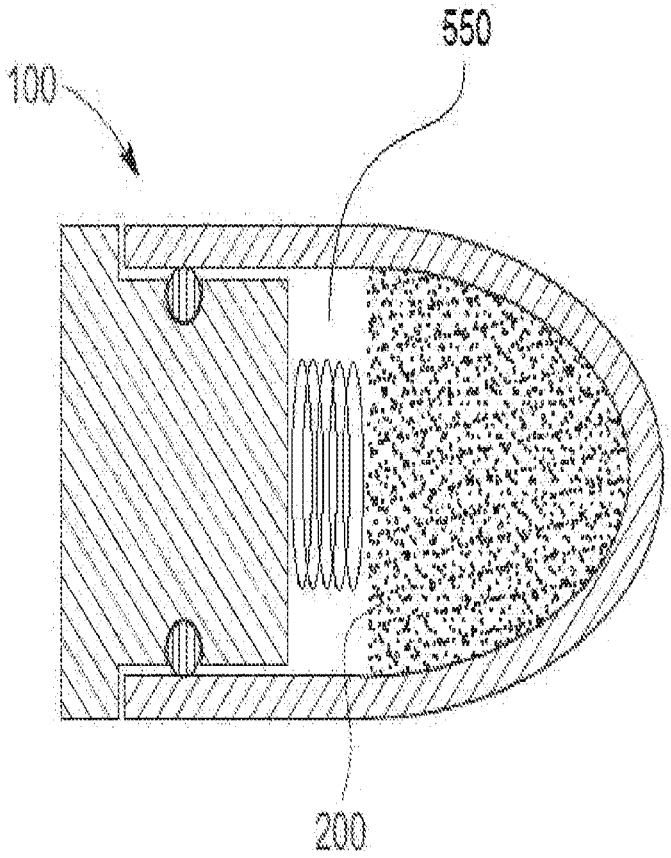
FIG. 3 shows a projectile comprising a payload and a coil of wire, according to an exemplary embodiment of the present disclosure.

In an embodiment and referring again to FIG. 1A, a launcher 1000 comprises at least one permanent magnet (hereinafter "magnet" as used throughout shall mean a permanent magnet unless particularly specified otherwise). The at least one magnet 500 may be disposed within or in proximity to the barrel 1010 of the launcher, and in a further embodiment, proximate to the point of projectile exit, and in any event along the launch axis of the projectile. The at least one magnet is preferably magnetically-aligned with the launch axis in an embodiment similar to the alignment of the at least one magnet of the launcher accessory shown in FIG. 4 herein. In an embodiment and as shown in FIG. 3, the projectile 100 comprises at least one coil of wire 550. In an embodiment, when the projectile is launched, the at least one magnet of the launcher causes a rapid change in magnetic flux of coil of the moving projectile as it moves along the launch axis. This rapid change causes a current to be induced through the coil of the projectile, causing an inductive energy to be produced. In this way, it is understood that the at least one magnet of the launcher is capable of providing energy to the projectile. Those familiar in the art will recognize this as Faraday's Law of Induction. That is, electrical energy can be generated thereby from the change in magnetic flux as the projectile moves through the magnetic field caused by the at least one magnet of the launcher. As used herein, this inductive method may be referred to as "inductive activation" when it refers to activating a circuit and/or initiator of the projectile.

Figure 4:
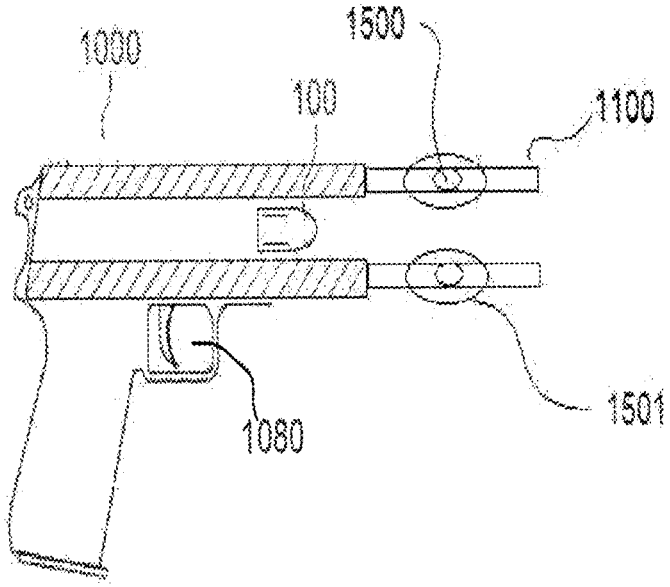
FIG. 4 shows an accessory for a launcher, according to an exemplary embodiment of the present disclosure.

In another embodiment and as shown in FIG. 4, an accessory 1100 for a launcher 1000 comprises at least one magnet 1500. The accessory is configured to be removably attached to a launcher, and in an embodiment, to the barrel of a launcher. The at least one magnet of the accessory may be disposed within or in proximity to the barrel of the launcher, and along the launch axis of the projectile. The at least one magnet is preferably magnetically-aligned with the launch axis. In an embodiment, accessory 1100 comprises multiple magnets (as shown as elements 1500 and 1501 in FIG. 4). As used herein, magnetic alignment comprises the creation of magnetic flux lines in the barrel or accessory such that a coil moving through the barrel or accessory receives an induced electrical charge. In an embodiment, the projectile comprises at least one coil of wire. When the projectile is launched, the at least one magnet of the launcher accessory causes a rapid change in magnetic flux of coil of the moving projectile as it moves along the launch axis. This rapid change causes a current to be induced through the coil of the projectile, causing an inductive energy to be produced. In this way, it is understood that the at least one magnet of the launcher accessory is capable of activating a circuit or an initiator of a projectile.

Figure 5:
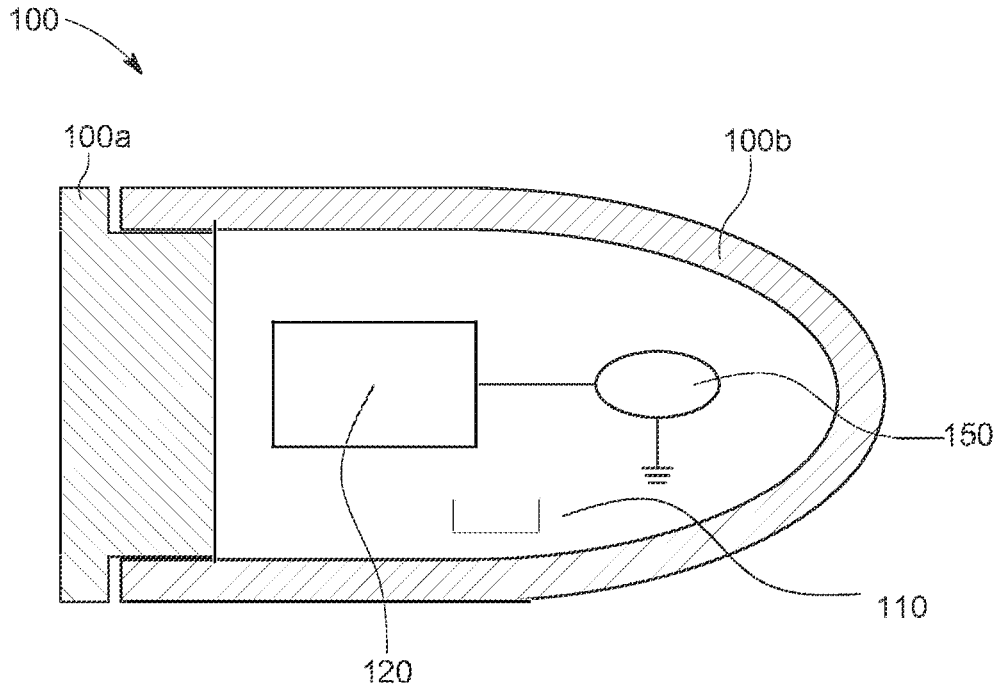
FIG. 5 shows an initiator, control circuit, and sensor of a projectile, according to an exemplary embodiment of the present disclosure.

In another embodiment and referring to FIG. 5, an initiator 150 may be disposed within the projectile. The initiator may either initiate a chemical reaction or otherwise cause a separation of the projectile through a mechanical or electromechanical method such as upon receiving a signal from a control circuit 120 of the projectile. The initiator and reaction can be initiated when current has been induced in the coil of wire of the projectile by the at least one magnet. In an embodiment, the initiator comprises an electric match, a nichrome wire coupled with a mechanical energy storage device (such as a spring), or a resistive heating filament. In an embodiment, the nichrome wire, when activated may cause the spring to expand to rupture the projectile.

In a still further embodiment in which the separation, opening, etc. of the projectiles is a result of a chemical reaction, an activating compound such as nitrocellulose may be initiated with the electric match, for example. The electric match may consist of a nichrome or similar high resistance wire that is coated with a pyrogen. In an embodiment, wherein the launcher and/or launcher accessory comprises at least one magnet, when the projectile is launched, the at least one magnet of the launcher and/or accessory can activate the electric match by inductive activation.

In embodiment, a projectile comprises piezoelectric material to generate a spark to start a reaction in the projectile and/or cause the projectile to rupture, separate, etc.

In another embodiment, the projectile comprises a propeller or other agitator for facilitating distribution of the payload.

In an embodiment, a projectile capable of rupturing/disintegrating and/or delivering a payload to a target comprises at least one sensor 110, as shown in an exemplary embodiment in FIG. 5. Said sensor may be capable of sensing a target and proximity to a target, and in an embodiment, a frequency or frequencies and/or amplitude or amplitudes emitted by a target. In an embodiment, the sensor may comprise an electromagnetic interference detector sensor and/or a radio frequency detection scanner. In operation, the sensor may provide inputs to a control circuit 120 so that the control circuit may initiate the disintegration operation (via the initiator 150, for example) or delivery of the payload of the projectile such as on determining the presence and/or strength of a particular frequency, electromagnetic interference, or radio frequency that may be associated with the target and that indicates a particular proximity to the target.

In an embodiment, said projectile may comprise or be operatively coupled to a library or index of frequencies, amplitudes, and electromagnetic signatures for purposes of comparing a sensed frequency, amplitude and/or electromagnetic signature with indexed frequencies, amplitudes, and electromagnetic signatures for associating the sensed frequency, amplitude, and or electromagnetic signature with a particular target.

In an embodiment, the at least one sensor may be combined with one or more supplemental sensors, including, but not limited to light and electromagnetic sensors, to improve target identification and optimal deployment proximity.

In an embodiment, delivery of the payload of the projectile may be used for debris field creation for mechanical disablement of the target.

In operation, this exemplary projectile may be configured to disintegrate and/or disperse a payload upon determination (such as by a sensor) that the projectile is in sufficient proximity to the target, the sensor can inform the control circuit of the projectile, and the control circuit can initiate disintegration of the projectile for delivery of the payload to the target.

Figure 6A:
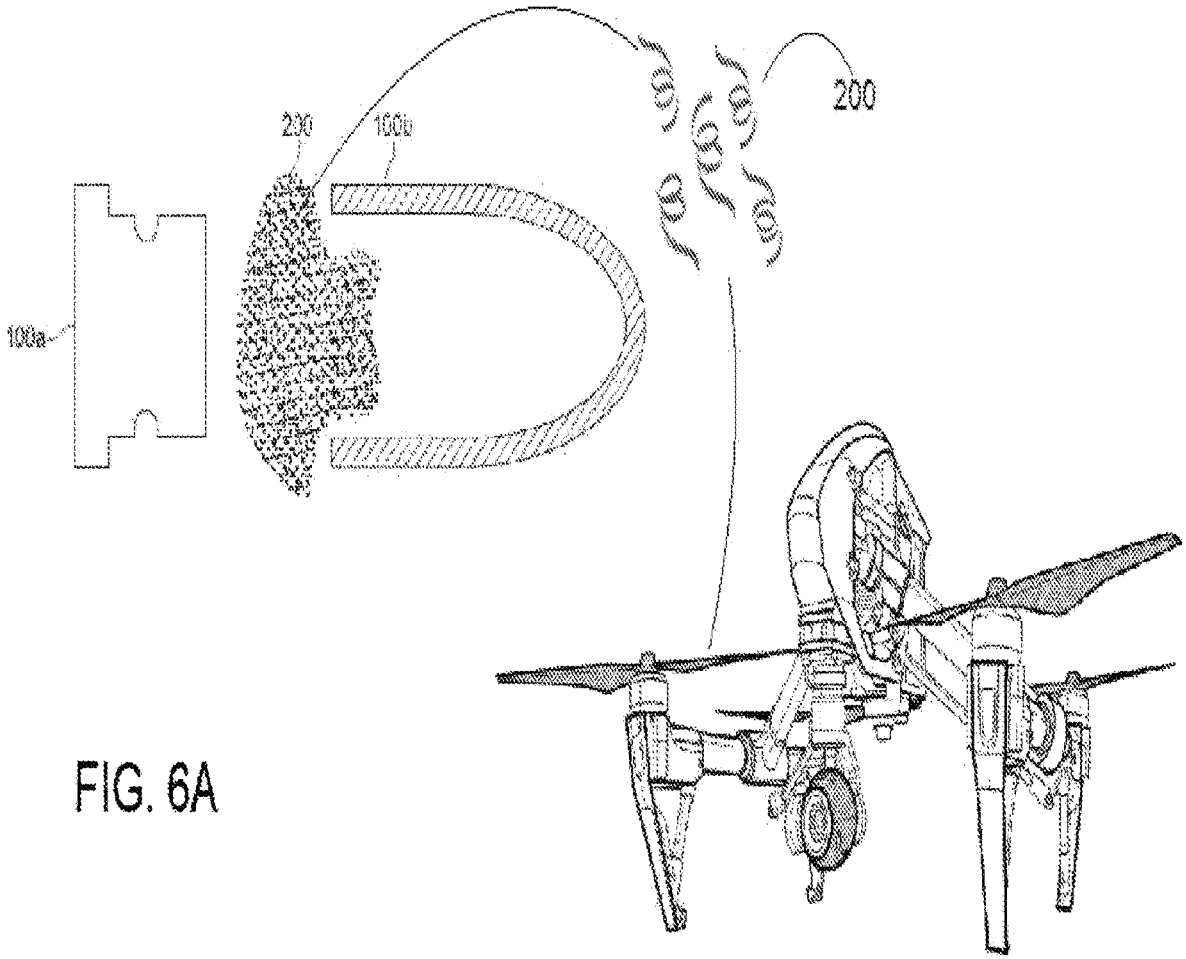
FIG. 6A shows a projectile releasing a payload upon a drone after separation of said projectile, according to an exemplary embodiment of the present disclosure.

In an embodiment, the projectile may disrupt a drone or other moving object by dispensing a payload that obscures or interferes with a drone's (or other object's) navigation system or flight mechanism. For example, a payload that comprises a ferrofluid and/or a magnetic or ferromagnetic powder may be dispersed from a projectile to adhere to a magnetic element of the drone such as the propeller motor for example, and cause the motor to cease operating, thus disabling the drone. In another embodiment, where the payload comprises an abrasive powder or streamers (or other entanglement materials), for example, delivery of the payload may be the result of the payload's attraction to the static charge created by the rotation of the propeller or propellers of the drone. In such an embodiment as shown in FIG. 6A, the payload 200 may contact and interfere with the propeller or propellers of the drone, thus impeding operation of the propeller(s) of the drone.

Figure 6B:
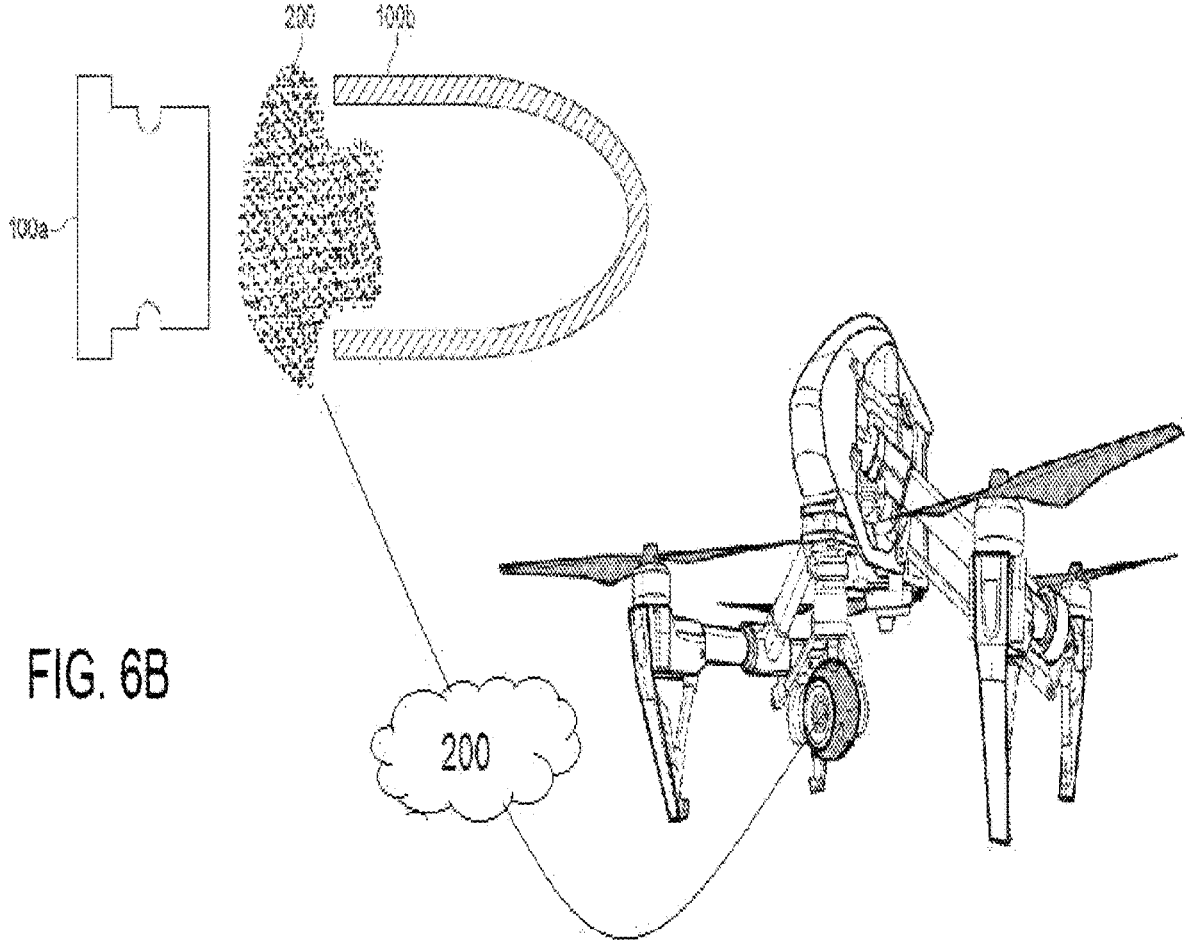
FIG. 6B shows a projectile releasing a payload upon a drone after separation of said projectile. according to another exemplary embodiment of the present disclosure.

In yet another embodiment (as shown in FIG. 6B), the payload 200 of a projectile may comprise an opaque substance (such as a foam, ink or paint), which opaque substance may be dispersed in proximity to the drone's vision system or camera to impede operation of the drone. In an embodiment, the opacity of such payload is from 0.2 to 1. In the alternative, the payload may be dispersed in an anticipated flight path of the drone such that the payload is delivered to the drone when the drone flies through a cloud or mass of the payload. In an embodiment, the payload may further comprise a sticky substance, which sticky substance may adhere to a portion of the drone to disrupt the flight capability of the drone by affecting control surfaces such as propellers, rudders and the like and/or drone sensors such as optics (including thermal and infrared sensing capabilities of a drone) or infrared targeting.

In an embodiment, the payload comprises a flammable powder or liquid aerosol which after dispersion in air creates a cloud which is then ignited to form a shock wave. The ensuing shockwave from said ignition destabilizes the target UAV or drone. Suitable materials can be any of a number of metals such as finely divided magnesium or aluminum or other materials such as aerosol fuels. This type of approach is often referred to as thermobaric.

The projectile, launcher, and launcher accessory disclosed herein offer the advantages of more controlled release of payload than existing solutions can offer. The projectile further does not require impact upon a target. Configuration of the shell of the projectile disclosed herein may also increase accuracy of flight of the projectile to further improve the safety of use of the projectile disclosed herein (and furthermore, collateral damage by the payload is minimized compared to the prior art). For example, projectile can have a semi-hemispherical shape to cut through the air. Projectile can have rifling engaging features to impart spin on the projectile. Furthermore, the projectile can be kept in an unarmed state until the projectile is launched from the launcher. The payload of the projectile disclosed herein may greatly reduce the targeting and operational capability of a drone or other moving object. The projectile of the present disclosure can be integrated into existing military and/or police force infrastructure. For example, the projectile may be between 12-45 mm and may be fired by an M203 launcher, which launchers are commonplace in military and police force settings.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A device configured to travel along a trajectory, the device comprising:

a set of payloads configured to interact with at least one of an airborne device or a component of the airborne device via at least one of physical entanglement, sensor obscuration, or surface adhesion; and a mechanism operable between an inactive state and an active state, wherein the mechanism is configured to:

transition to the active state in response to inductive energy generated by relative motion through a magnetic field during launch, and deploy the set of payloads based on at least one of:

one or more elapsed times during travel of the device along the trajectory, one or more positions of the device along the trajectory, or one or more distances traveled by the device along the trajectory, wherein at least one payload of the set of payloads includes a set of visual cues including at least one of the physical entanglement, a tracer compound, a color-coded dye, or a phosphorescent marker, the set of visual cues being configured to indicate at least one of a release path or an interaction region.

2. The device of claim 1, wherein at least one of the physical entanglement, the sensor obscuration, or the surface adhesion comprises:

physically entangling using an entanglement element, providing contact-based disruption using at least one fragment, impairing at least one sensor using airborne obscurant particles, providing thermal interference, providing spectral sensing disruption, or providing adhesive surface alteration.

3. The device of claim 1, wherein at least one payload comprises particles having shapes and sizes configured to promote suspension in air and impair at least one sensor associated with the airborne device, the shapes comprising at least one of a flake shape or a spherical shape and the sizes being less than or equal to 100 microns.

4. The device of claim 1, wherein at least one payload comprises an entanglement element composed of at least one of an ultra-high-molecular-weight polyethylene (UHMWPE), a nylon, a polyester, a cellulose, or a cellulose-based material, and wherein the entanglement element is configured to at least one of unwind or unravel during travel of the device along the trajectory to create an entanglement volume.

5. The device of claim 1, wherein the mechanism, to deploy the set of payloads, is further configured to utilize at least one of:

a spring-loaded deployment system, a pyrotechnic actuator, an inertially-triggered release system activated by at least one of an acceleration threshold or a velocity threshold, or a rupture-based pressure vessel configured to fail along a pre-weakened seam associated with the device.

6. The device of claim 1, wherein at least one payload comprises a set of particles including at least one of magnetically-responsive materials or iron-containing particles configured to impair at least one of a magnetic system or an electronic system of the airborne device.

7. The device of claim 1, wherein the set of payloads includes one or more entanglement elements coupled to the device and configured to be deployed, during travel of the device along the trajectory, in a direction opposite to a direction of travel of the device, the one or more entanglement elements further being configured to at least one of unroll or extend to form an elongated aerial denial volume, wherein the device is stabilized based on the one or more entanglement elements.

8. The device of claim 1, wherein the physical entanglement includes one or more streamers.

9. The device of claim 1, wherein the physical entanglement includes one or more filaments.

10. A device configured to travel along a trajectory, the device comprising:

a set of payloads configured to interact with at least one of an airborne device or a component of the airborne device via at least one of physical entanglement, sensor obscuration, or surface adhesion; and a mechanism operable between an inactive state and an active state, wherein the mechanism is configured to:

transition to the active state in response to inductive energy generated by relative motion through a magnetic field during launch, and deploy the set of payloads based on at least one of:

one or more elapsed times during travel of the device along the trajectory, one or more positions of the device along the trajectory, or one or more distances traveled by the device along the trajectory, wherein at least one payload includes at least one of a set of fluids or a set of gels including at least one of a glycerin-based mist, a biodegradable tackifier, a cyanoacrylate-based, a urethane material, a latex material, or a rubber-based agent configured to provide adhesive surface alteration.

11. A system, comprising:

a first device comprising:

a set of payloads configured to interact with at least one of an airborne device or a component of the airborne device via at least one of physical entanglement, sensor obscuration, or surface adhesion;

a mechanism operable to transition from an inactive state to an active state; and a second device configured to create a magnetic field and impart motion to the first device, the first device being configured to travel along a trajectory based on the motion, wherein the mechanism is configured to:

transition to the active state based on inductive energy generated by moving through the magnetic field, and deploy the set of payloads based on at least one of:

one or more elapsed times during travel of the first device along the trajectory, one or more positions of the first device along the trajectory, or one or more distances traveled by the first device along the trajectory, wherein the mechanism is further configured to deploy payloads sequentially to form multiple interaction zones, and wherein interaction zones, of the multiple interaction zones, are at least one of spatially distinct from one another or formed at different times.

12. The system of claim 11, wherein the first device comprises a housing configured to separate, during travel of the first device along the trajectory, into one or more fragments that disperse in air, the one or more fragments being configured to physically engage with at least one of the airborne device or the component of the airborne device.

* * * * *